United States Patent [19]

Bisbing

[11] Patent Number: 4,830,413

[45] Date of Patent: May 16, 1989

[54] FLEXIBLE DRAW LATCH

[75] Inventor: Robert H. Bisbing, Springfield, Pa.

[73] Assignee: Southco, Inc., Concordville, Pa.

[21] Appl. No.: 118,291

[22] Filed: Nov. 6, 1987

Related U.S. Application Data

[63] Continuation-in-part of Ser. No. 47,263, May 8, 1987, abandoned, which is a continuation-in-part of Ser. No. 928,415, Nov. 7, 1986, abandoned.

[51] Int. Cl.[4] ..... E05C 5/02

[52] U.S. Cl. ..... 292/247; 292/DIG. 38; 292/DIG. 49

[58] Field of Search ..... 292/247, 113, DIG. 49, 292/DIG. 38, 1, 66, 340

[56] References Cited

U.S. PATENT DOCUMENTS

| | | | |
|---|---|---|---|
| 2,206,848 | 7/1940 | McAvoy | 292/247 |
| 2,743,029 | 4/1956 | Mautner | 292/113 X |
| 2,829,912 | 4/1958 | Koch | 292/340 X |
| 3,134,617 | 5/1964 | Slonneger | 292/113 X |
| 3,490,805 | 1/1970 | DiPierro et al. | 292/113 X |
| 3,618,995 | 11/1971 | McLean | 292/247 X |
| 3,985,380 | 10/1976 | Raivio | 292/DIG. 38 X |
| 4,035,016 | 7/1977 | Ricca | 292/113 X |
| 4,326,739 | 4/1982 | Schlueter | 292/247 |
| 4,540,206 | 9/1985 | Frame et al. | 292/66 |

*Primary Examiner*—Richard E. Moore
*Attorney, Agent, or Firm*—Paul & Paul

[57] ABSTRACT

A flexible draw latch for use in securing two closure members together comprises a keeper adapted to be affixed to one of the closure members, a mounting bracket adapted to be affixed to the other closure members, a mounting bracket adapted to be affixed to the other closure member, a lever pivotally connected to the mounting bracket, and a locking member made of a flexible, resilient material pivotally connected to the lever wherein the locking member is detachable connected to the keeper and wherein the locking member is disposed in overlying relation to the keeper, the mounting bracket and the lever when the latch is in a closed, latched position and wherein the pivot connection between the lever and the locking member is closer to the closure member than the pivot connection between the lever and the mounting bracket when the latch is in a closed, latched position. A cross-pin is transversely disposed within the keeper-engageable portion of the locking member to prevent localized deformation and to relieve stress on the locking member. Longitudinal ribs are provided to lower the neutral axis of the locking member and help prevent the locking member from bending when elongated.

24 Claims, 4 Drawing Sheets

FLEXIBLE DRAW LATCH

CROSS-REFERENCE TO RELATED U.S. APPLICATIONS

This application is a continuation-in-part of my copending U.S. application Ser. No. 047,263, filed May 8, 1987 which, in turn, is a continuation-in-part of my copending U.S. application Ser. No. 928,415, filed Nov. 7, 186, both now abandoned, the disclosures of which are herein incorporated by reference.

BACKGROUND OF THE INVENTION

This invention relates generally to over-center draw latches for use in securing two closure members together. More specifically, the present invention relates to over-center draw latches of the flexible or elastic type.

Many types of over-center draw latches are generally known in the art. One such type of over-center draw latch is taught in my U.S. Pat. Nos. 3,181,095, issued May 4, 1965; 3,466,076, issued Sept. 9, 1969. The latches disclosed in these patents essentially comprise a keeper and a one-piece part having three segments: a base segment, a locking segment, and an intermediate segment wherein the intermediate segment is flexibly connected to the base and locking segments. When in a latched condition, the locking segment is detachably connected to the keeper and is in overlying relation to the keeper, the base segment, and the intermediate segment.

Another known over-center draw latch is disclosed in U.S. Pat. No. 4,540,206, issued Sept. 10, 1985, which comprises a keeper, a mounting bracket, an adjustable lever connected to the mounting bracket, and a locking member connected to the adjustable lever. The adjustable latch, which is made entirely of molded plastic resin, incorporates an adjustability feature to compensate for variations in the closure members in manufacturing or due to deformation during use.

These latches were often considered desirable because they provided positive over-center latching, were lightweight and also were inexpensive to manufacture. Furthermore, these latches were attractive in appearance. Typically, however, these latches were of a molded plastic construction and were incapable of use in situations where high loads were placed on the latch. Another disadvantage in these latches was the fact that considerable precision was required in the installation of the latch and the keeper in order for the latch to operate properly.

Flexible draw latches are also known in the art and have been used for many years. Perhaps the simplest example of a flexible draw latch comprises a mounting bracket, a rubber stretch arm affixed to the bracket, and a keeper. These flexible draw latches are typically used to secure loose fitting hoods or covers on heavy machinery or mechanical equipment. In operation, the rubber stretch arm would be pulled up and into engagement with the keeper, whereby the elasticity of the rubber arm would keep the hood or cover secure. Although these latches were not very pleasing in appearance and did not provide the more positive over-center latching action, they were considered desirable because the flexibility of the rubber arm compensated for misalignment of the bracket and keeper during installation. The flexibility of these latches also permitted the closure members to move relative to one another without causing the latch to release and thus were considered desirable for use in situations where vibrations of the panels was to occur. Moreover, the relative movement of the closure members in all directions would cause the displacement and misalignment of the keeper and mounting bracket during use, even if they were properly aligned in installation. The flexibility of the latch, unlike the plastic draw latches, permitted the latch to compensate for these misalignments without releasing. Another advantage of these flexible draw latches was that the load capability of the latch could be varied, within a range, by simply increasing or decreasing the distance between the bracket and the keeper and, thus, the tension on the rubber stretch arm. In high load situations, this type of latch became impractical, however, because of the difficulty in stretching the heavy-duty rubber arm required in such situations.

Another type of flexible draw latch is also known which was primarily developed to overcome the disadvantages of the above-mentioned flexible latch by providing a lever handle to assist in stretching the rubber arm. Essentially, these lever-assisted flexible draw latches comprise a bracket, a rubber stretch arm, a lever handle and a keeper. The rubber stretch arm is connected at one end to the bracket and connected at the other end to the lever at a point intermediate the ends of the lever. To operate the latch, the lever handle was inserted in the keeper and pivoted to stretch the rubber arm and then seating to secure the latch with a positive over-center action. Despite its advantages over the previous flexible draw latches, however, these lever assisted latches were considered unsightly and their use was essentially limited to high load situations where heavy-duty latches are required.

I have invented a simple draw-pull latch for use in securing two closure members together which provides the advantages of a flexible locking member in an aesthetically pleasing latch which is inexpensive to manufacture, easy to use, and has a wide variety of practical applications.

SUMMARY OF THE INVENTION

Briefly, the present invention comprises a flexible overcenter draw latch for use in securing two closure members together, comprising a keeper adapted to be affixed to one of the members, a mounting bracket adapted for being affixed to the other member, a lever pivotally connected to the mounting bracket, and an elastomeric locking member pivotally connected to the lever. In operation, the locking member is disposed over the keeper and pushed toward the closure member to a latched position overlying the bracket, the keeper and the lever, whereby the latch is secured by a positive over-center latching action. The tail end of the locking member is provided with a concave surface to facilitate the lifting of the locking member to an unlatched position. The nose end of the locking segment is preferably provided with a transverse cross-pin which engages the keeper to prevent localized stress on the flexible locking member when the latch is in its closed position. Longitudinal ribs are preferably provided on the locking member to lower the neutral axis thereof and help prevent bending of the member during elongation.

Accordingly, it is a primary object of the present invention to provide a novel flexible draw latch.

It is another object of the present invention to provide a flexible draw latch having positive over-center latching action.

It is another object of the present invention to provide a draw latch having a flexible locking member.

It is a further object of the invention to provide a flexible draw latch having variable load capabilities.

It is another object of the invention to provide a flexible over-center draw latch wherein the flexible locking member is in overlying relation to the rest of the latch components when in the latched condition.

It is a further object of the invention to accomplish the above objects by providing a keeper, a mounting bracket, a lever pivotally connected to the mounting bracket and a flexible locking member pivotally connected to the lever and having a nose end adapted to engage the keeper.

It is another object of the invention to provide a latch having the above objects wherein the nose end of the latch is provided with a transverse cross-pin which engages the keeper to relieve the stress on the locking member.

It is a further object of the invention to accomplish the above object in a flexible draw latch operated by a simple push- to-latch of lift-to-unlatch action.

It is another object of the present invention to provide a flexible over-center draw latch having an elastomeric locking member having sufficient flexibility to permit latching engagement when the keeper and mounting bracket are misaligned.

It is another object of the invention to accomplish the above object by providing an elastomeric locking member that elongates by at least substantially 1% as it passes over-center.

It is another object of the invention to provide a flexible over-center draw latch having an elastomeric locking member having sufficient stretch characteristics to elongate as the locking member crosses over-center without exerting appreciable compressive forces in the lever or the bracket.

It is another object of the invention to provide a flexible over-center draw latch having an elastomeric locking member having means thereon for lowering the neutral axis of the locking member to counteract the bowing tendency of the locking member on elongation.

These and other objects of the invention will become apparent upon a reading of the following detailed description of the invention with reference to the drawings, and the appended claims.

Figure 9:
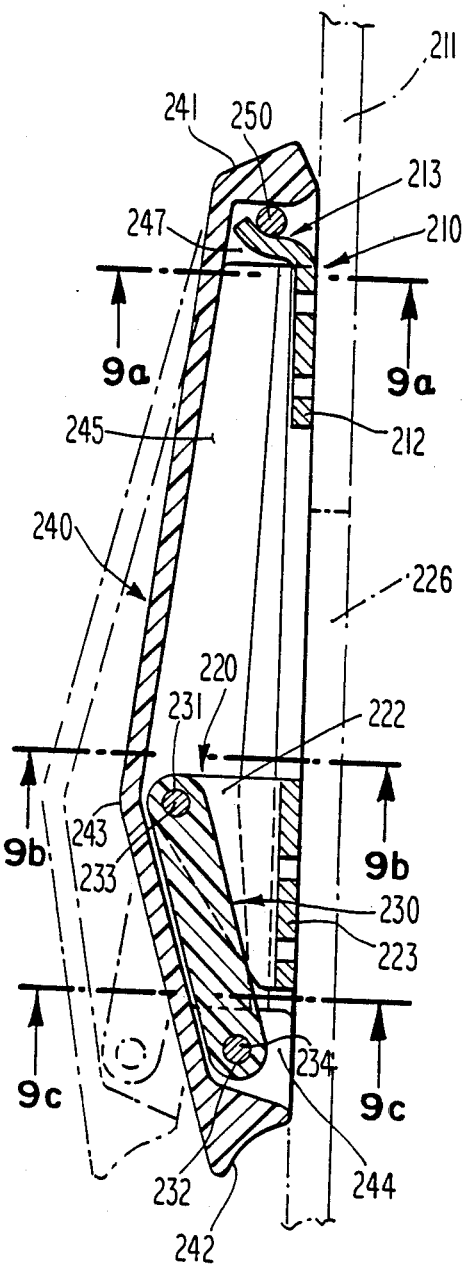
FIG. 9 is a sectional view similar to FIG. 6 of a preferred embodiment of the present invention in the latched condition, with the elongated condition of the locking member as the locking member passes over-center being illustrated in phantom.

FIGS. *9a–9c* are cross sectional views of the locking member in the preferred embodiment as seen along lines a—a, b—b, and c—c, respectively of FIG. 9, illustrating the means for lowering the neutral axis of the locking member.

Figure 10:
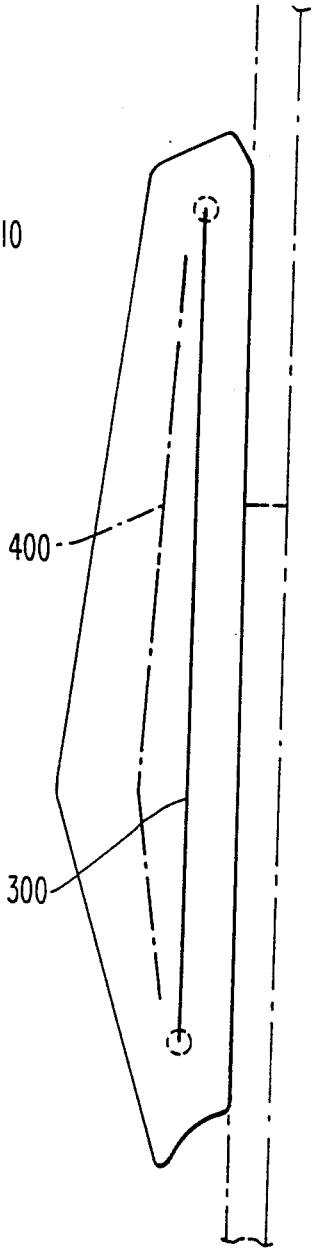

FIG. 10 is a schematic illustration of the locking member of the preferred embodiment illustrating the neutral axis and its relationship to the line of loading of the latch.

DETAILED DESCRIPTION OF THE INVENTION

Figure 1:
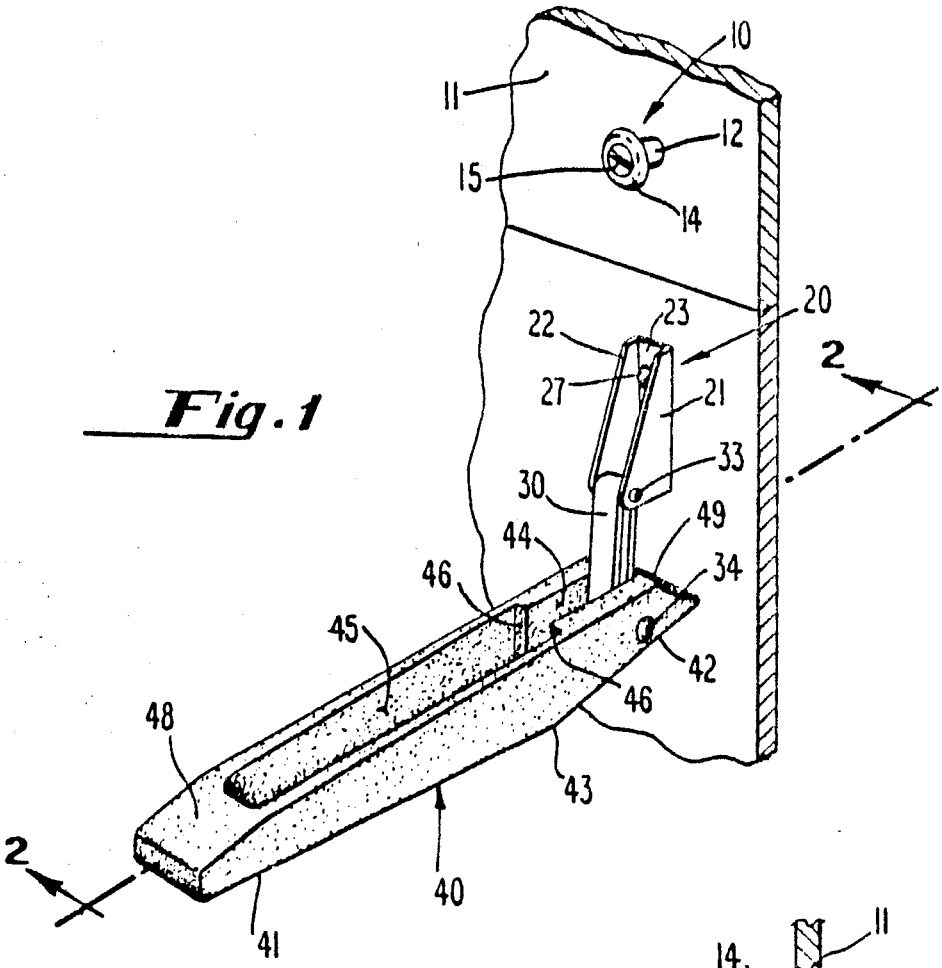
FIG. 1 is a perspective view of one embodiment of the present invention, as mounted to a pair of closure members, illustrated in the unlatched condition.
Figure 2:
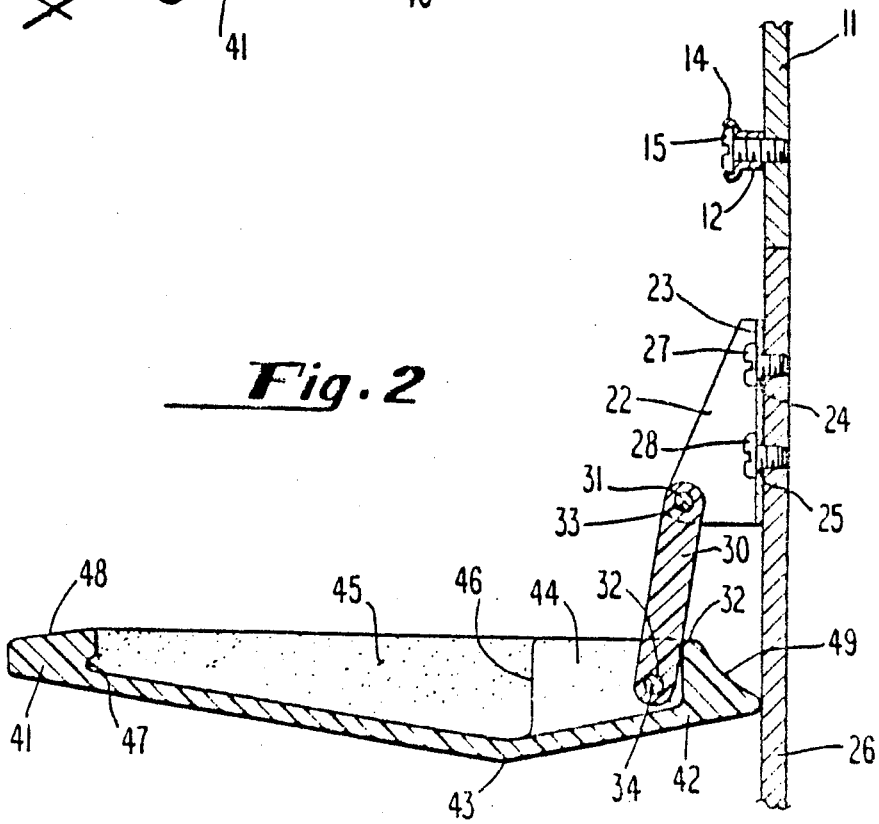
FIG. 2 is a sectional view of the invention taken along line 2—2 of FIG. 1.

With reference now being made to the Figures, particularly FIG. 1, the flexible over-center draw latch of the present invention comprises a keeper 10, a mounting bracket 20, a lever 30, and a locking member 40 which is made of an elastomeric material having sufficient stretch and recovery characteristics as explained below. As seen in FIGS. 1 and 2, keeper 10 is adapted to being affixed to a closure member, such as panel 11, and comprises a cylindrical member 12 having a bore 13 therethrough and an outwardly extending annular flange 14 at the outer end of cylindrical member 12. As seen in the Figures, keeper 10 is affixed to panel 11 by a screw 15 or other suitable fastener disposed within the bore 13 of cylindrical member 12. With reference to FIG. 2, the annular flange 14 forms a seat for the head of screw 15 to provide a smooth exterior contour on the face of keeper 10, when assembled. In a preferred embodiment, keeper 10 is made of stamped metal construction.

Mounting bracket 20, as seen in FIGS. 1, is preferably a wedge-shaped member having spaced-apart opposing side walls 21,22 and a bottom wall 23. Bottom wall 23 is preferably provided with a pair of spaced-apart apertures 24,25 to facilitate the mounting of mounting bracket 20 to a closure member, such as panel 26, by screws 27,28 or other suitable fasteners. In a preferred embodiment, mounting bracket 20 is of a stamped metal construction, preferably stainless steel.

Lever 30, as seen in the Figures, comprises a bar having a transverse aperture 31,32 at the longitudinal ends thereof through which is disposed a pin 33,34 or the like to facilitate the pivotal mounting of lever 30 to mounting bracket 20 on the one end and locking member 40 on the other. Lever 30 is preferably of molded or extruded plastic construction. As seen in the Figures, lever 30 is mounted near the outer edges of side walls 21,22 of mounting bracket 20, whereby lever 30 is held in spaced relation to the face of panel 26.

Locking member 40, as mentioned previously, is preferably made of elastomeric material having sufficient stretch and recovery properties. As seen in FIGS. 2-6, locking member 40 is preferably of substantially flattened triangular shape having a nose section 41, a tail section 42 and a crown 43 on the exterior face of locking member 40 intermediate the nose and tail sections. As seen in FIG. 1, the interior face of locking member 40 is provided with a relatively narrow channel 44 in tail section 42, which channel 44 is sized to substantially coincide with the width of lever 30 and to receive lever 30 therein when the latch is moved to a latched position (See FIG. 6). Extending from channel 44 toward nose section 41 is a channel 45 which, as seen in FIG. is substantially longer and wider than channel 44, whereby a shoulder 46 is formed between the connection of the channels 44 and 45.

Figure 6:
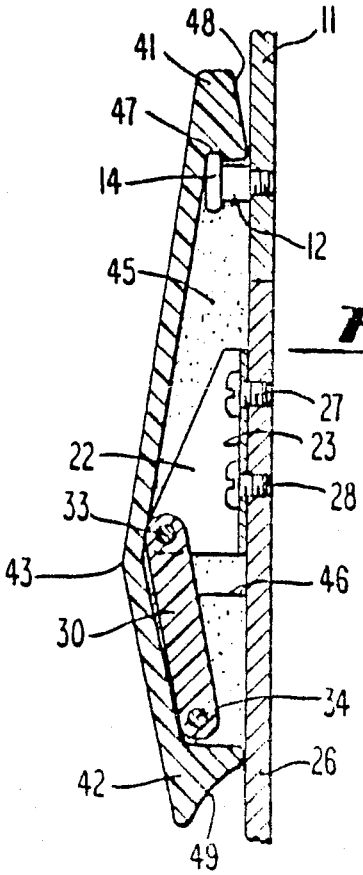
FIG. 6 is a sectional view taken along line 6—6 of FIG. 5.

As also seen in FIG. 1, channel 45 is widest at the point adjacent shoulder 46 and is sized so as to receive therein the mounting bracket 20 when the latch is moved to a latched position (See FIG. 6). From its widest point, channel 45 narrows slightly as it extends toward nose section 41, whereby the cross-sectional area of the elastomeric material of locking member 40 along channel 45 is constant. In this construction, the elongation or stretch of locking member 40 when the latch is closed is uniform to prevent the formation of "weak points" in the locking member and consequential localized deformation and fatigue of the elastomeric material. A notch 47 is provided at the end of channel 45 adjacent the nose section 41 (See FIG. 2) which is adapted to receive therein the annular flange 14 of keeper 10 when the latch is closed, as seen in FIGS. 4 and 6.

Figure 4:
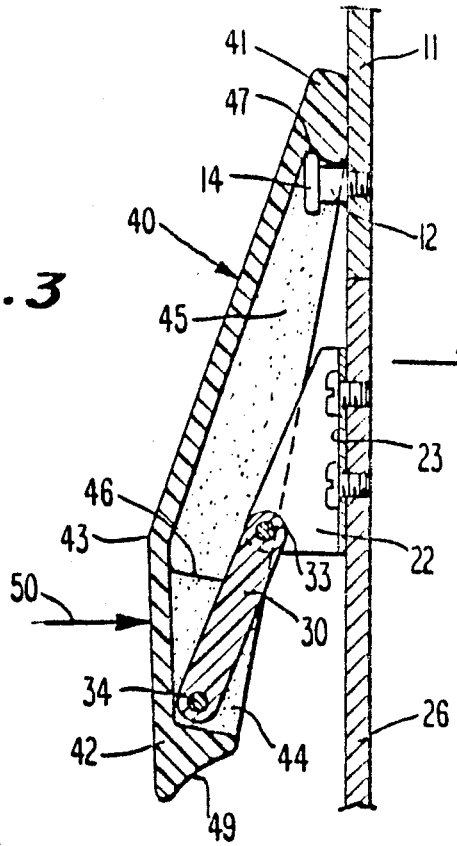
FIG. 4 is a sectional view taken along line 4—4 of FIG. 3.

The inner face 48 of nose section 41, as seen in the Figures, is beveled slightly outwardly and upwardly to facilitate the engagement of locking member 40 with the keeper 10 (See FIGS. 4 and 6). In this embodiment, inner face 48 of nose section 41 forms a 10° angle with the vertical as illustrated in FIG. 6, which has been found to provide sufficient clearance for engaging keeper 10 and further to reduce localized deformation and fatigue of the nose section 41 when the latch is closed.

The end of tail section 42 is provided with a concave surface 49 which facilitates the unlatching of the latch by an outward pull of tail section 42 away from panel 26, as described hereinbelow.

Figure 7:
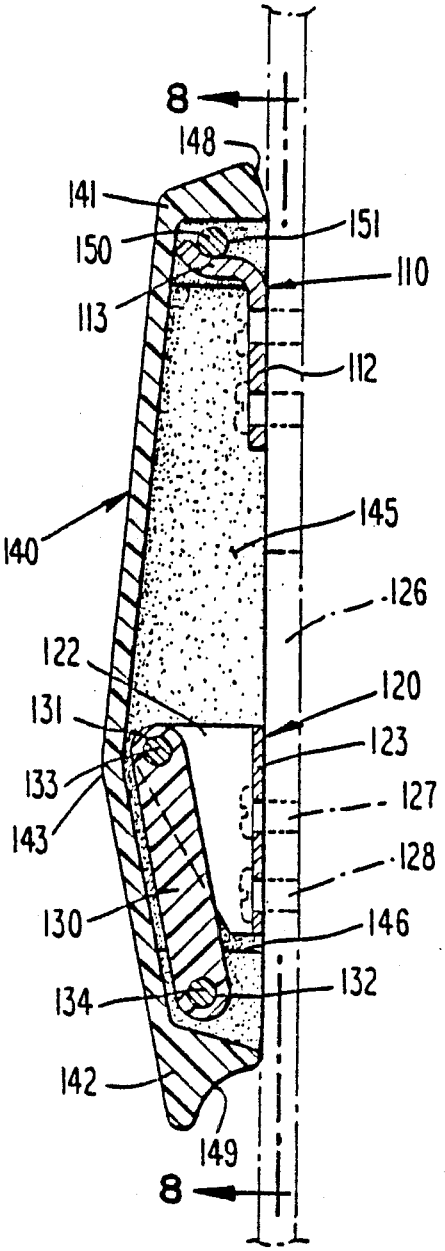
FIG. 7 is a sectional view similar to FIG. 6, showing another embodiment of the invention in which the nose end of the locking member is provided with a transverse cross-pin.
Figure 8:
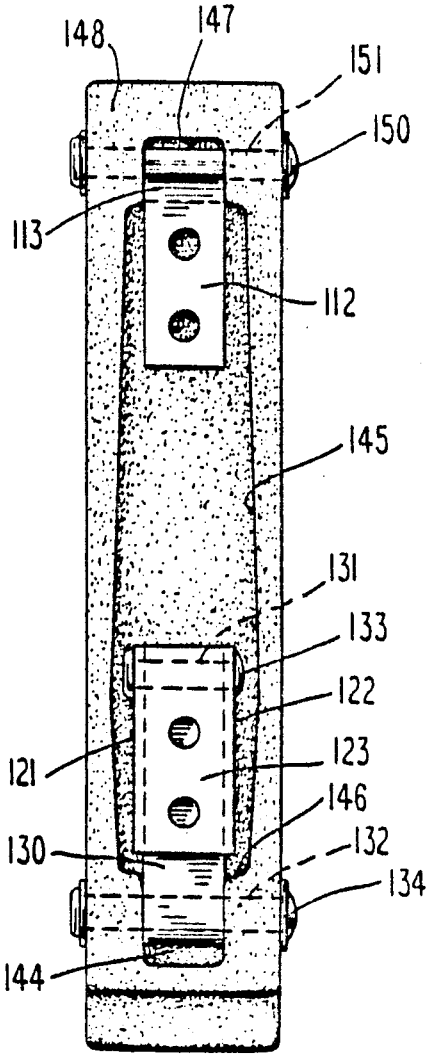
FIG. 8 is a rear elevational view of the embodiment of the invention taken along line 8—8 of FIG. 7.

With reference to the embodiment of the invention illustrated in FIGS. 7 and 8, the latch comprises a keeper 110 having a mounting region 112 and a curved leg region 113. The mounting region 112 is adapted for being affixed to panel 111 such as by screws or the like disposed within apertures in the mounting region 112. As seen in FIG. 7, curved leg region 113 is of an S-shaped configuration and is attached to the mounting region 112 so as to project outwardly from panel 111.

A bracket 120 is also provided for mounting the latch to panel 126 and has the same shape and configuration as described above. That is, bracket 120 comprises a pair of spaced-apart side walls 121,122 and a bottom wall 123 which bottom wall 123 is adapted for being affixed to panel 126 by screws or the like 127,128. Lever 130 is pivotally connected to bracket 120 by pin 133 and is connected to tail section 142 of locking member 140 by pin 134 as described above in connection with the other embodiments. Locking member 140 is also of similar shape and design as above-described, having a channel 144 in tail end 142 thereof to accommodate lever 130 therein and a larger channel 145 adjoining channel 144 so as to form a shoulder 146. It should be noted that channels 144 and 145 are of slightly different configuration due to the reverse orientation of mounting bracket 120 in this embodiment. (Compare FIG. 6 and FIG. 7) This reverse orientation of mounting bracket 120 as seen in FIG. 7 is desirable because it allows for mounting of bracket 120 farther away from the terminal edge of panel 126 without unnecessarily increasing the overall length of the latch.

The nose end 141 of locking member 140 is different in construction than the previous embodiments and is provided with a channel 147 therein which is sized so as to receive curved leg 113 of keeper 110 (See FIG. 8). Transversely disposed through nose end 141 and channel 147 is a bore 151 within which is disposed a pin 150. As seen in broken lines in FIG. 8, cross-pin 150 traverses channel 147 whereby it engages with curved leg 113 of keeper 110 when the latch is moved to a closed position, whereupon cross-pin 150 nests within a concave depression of S-shaped curved leg 113.

In this embodiment, localized deformation at the nose end 141 of locking member 140 is virtually eliminated. In addition, the use of cross-pin 150 allows the locking member 140 to lie flat against the panel when in the latched condition for increased latching strength and better overall appearance.

With reference now being made to the preferred embodiment of the invention as illustrated in FIGS. 9–10, as seen therein, the latch comprises a keeper 210, a mounting bracket 220, a lever 230, and an elastomeric locking member 240.

Keeper 210 is identical to keeper 110 in the previous embodiment and comprises mounting region 212 adapted to be affixed to panel 211 such as by screws or the like. Connected to mounting region 212 and extending therefrom is a substantially S-shaped curved leg 213 which is adapted to engage the nose of locking member 240. Keeper 210 is preferably of metal construction.

The mounting bracket 220 is also similar to bracket 120 in the above-mentioned embodiment an comprises a wedge-shaped member having opposing side walls 221,222 connected to a bottom wall 223. Bottom wall 223 is adapted for being affixed to panel 226 such as by screws or like fasteners. As in the previous embodiments, bracket 220 is preferably of metal construction.

Lever 230, as seen in the Figures, is pivotally connected to side walls 221,222 of bracket 220 by a transverse pin 233 disposed through aperture 231 in lever 230. As before, the location of pin 233 is spaced from the bottom wall 223 of bracket 220 and panel 226 to facilitate the over-center arrangement of the latch. At the longitudinal end of lever 230 spaced from aperture 231 and pin 233 is another aperture 232 through which is disposed a transverse pin 234 which provides the pivot connection between lever 230 and locking member 240. The lever 230, as in the previous embodiments, is preferably extruded or molded of a rigid plastic material.

The locking member 240 is also substantially similar to the previously discussed embodiments and comprises a nose section 241, a tail section 242, and a crown 243 disposed intermediate the nose and tail sections. As before, the locking member 240 is provided with three contiguous channels therein. The first channel 244 is disposed in tail section 242 and is adapted to receive the lever 230 therein when the latch is moved to a closed, latched position. Adjacent channel 244 is a second channel 245 which is wider than channel 244 and extends longitudinally therefrom toward nose section 241. Channel 245 is adapted to receive the mounting bracket 220 therein when the latch is closed. A third channel 247 is disposed in nose section 241 and adjacent to channel 245 and is adapted to receive the S-shaped curved leg 213 of keeper 210. Traversing channel 247 and nose section 241 is a pin 250 which is adapted to engage the concave surface of curved leg 213 of keeper 210 to secure the latch.

As in the previous embodiments, the locking member 240 is made of an elastomeric material having sufficient stretch and recovery properties. The stretch characteristics of the elastomeric material must be such that the locking member 240 will elongate longitudinally as the lever 230 passes the over-center position without the application of an excessive amount of force. The recovery characteristics of the elastomeric material should be such that the locking member 240 will retain its shape for a prolong period of use and also such that a sufficient tensile stress is created in the locking member when the latch is closed to secure the closure members together while also permitting relative movement between the closure members due to vibrations or other forces. In addition, the elastomeric material must be flexible enough to compensate for misalignment of the bracket and keeper in order to fully achieve the objects of the present invention.

Moreover, it is advantageous from a manufacturing standpoint to use an elastomeric material which is inexpensive and which can readily be used in common manufacturing techniques, such as injection molding and the like. Furthermore, in those instances when the present invention will be used on machinery and other such applications where it will be exposed to the elements, the elastomeric material should be resistant to degradation by ultraviolet light, rain, etc. as well s a variety of chemical reactants. It is also advantageous, particularly in external applications, for the elastomeric material to retain its stretch and recovery characteristics over a wide range of temperatures and should also be resistant to heat aging. From an aesthetic standpoint, the elastomeric material should be resistant to cracking and fading and further should be available in a variety of colors.

One such elastomeric material which has been found to be particularly advantageous for use in the present invention is the thermoplastic rubber manufactured by Monsanto and marketed under the trademark SANTOPRENE®. This elastomeric material is available in durometer hardness of 55 Shore A to 50 Shore D, although in the present invention the durometer hardness of 55 Shore A to 87 Shore A is most suitable because harder elastomeric materials generally do not exhibit sufficient stretchability characteristics and the softer elastomeric materials generally do not possess the desired recovery characteristics. Elastomeric material of durometer hardness 73 Shore A has been found to be particularly suitable for most applications.

Due to the use of an elastomeric locking member which will be longitudinally elongated when in the latched condition, two phenomenons inherent in elastic mechanics arise in the present latch. The first phenomenon, already discussed, relates to the formation of "weak points" in the elastomeric material. This phenomenon of the elastomeric material occurs along the length of elongation. In the present invention, the locking member undergoes longitudinal elongation between the point of contact with the keeper and the point of contact with the lever, which, in the preferred embodiment, conincide with transverse pins 234, 250. In other words, the locking member in each of the above embodiments will elongate during operation substantially along the second channel. Thus, in order to prevent the formation of "weak points" in the locking member, the cross-sectional area of elastomeric material along the second channel remains constant whereby the tensile stress of the locking member during elongation is equally distributed between the right and left sides of the locking member.

The second phenomenon of elastic mechanics which occurs is a bending phenomenon. The bending phenomenon is the result of an elastomeric material having an asymetrical distribution of mass being stretched longitudinally, and is a function of the line of loading and the neutral axis of the elastomeric piece being stretched. The line of loading is defined as the theoretical line through which the tensile load is being generated, which, as seen in FIG. 10, is a straight line through the points of contact of the locking member and is illustrated in FIG. 10 as solid line 300. The neutral axis of a member is defined as the axis about which the mass of the member is evenly distributed. For example, in a symetrical member, the neutral axis is the geometric center of its cross-section. For asymetrical members, however, the neutral axis is displaced from the geometrical center and is closer to that portion of the member having the greater mass. When an asymetrical member is stretched under a given tensile load, that portion of the member having the greater mass will elongate less than that portion of the member having the lower mass and the member will bend or bow toward that portion having the greater mass.

For example, in the present invention, the locking member is asymetrical and has a greater distribution of mass at the upper portion, i.e., the mass of the locking member is greater to the left of line 300 in FIG. 10. As such, the locking member, when stretched, will bow outwardly away from the closure members. Because the nose of the locking member is secured by the keeper and the closure members support the right side (as seen in FIG. 10) of the locking member, the bowing forces will cause the tail section of the locking member to lift away from the panel. This leads to the undesirable result of decreasing the over-center action of the latch and may cause accidental opening of the latch. To compensate for the bending phenomenon, it is desirable to cause the neutral axis of the locking member to shift and approach the line of loading, the bending phenomenon being eliminated completely when the neutral axis coincides with the line of loading.

Figure 9A:
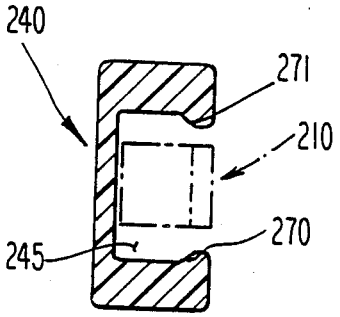
Figure 9B:
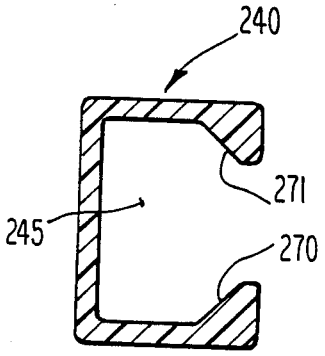
Figure 9C:
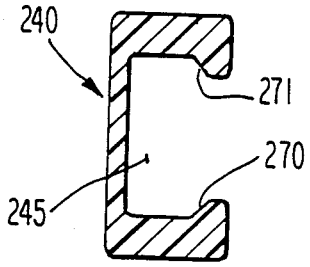

In order to achieve this objective, the locking member 240 of the preferred embodiment, as seen in FIGS. 9 and 9*a–c*, is provided with a pair of longitudinal ribs 270,271 along the channel 245 thereof and disposed on the side of the locking member which will be closest to the panels when the latch is closed. Longitudinal ribs 270,271 provide increased mass on the right hand side of the line of loading 300 (as seen in FIG. 10) which, in turn, moves the neutral axis to the right, toward the line of loading, and decreases the tendency of the latch to bend when stretched. The neutral axis of the preferred embodiment is illustrated as broken line 400 in FIG. 10. Although ribs 270,271 as seen in FIGS. 9*a–*9*c* are substantially triangular in crosssectional shape for ease of manufacturing, it is to be understood that other shapes may be employed. In addition, it is preferable for ribs 270,271 to be disposed on the inside of the locking member 240, that is, projecting into channel 245 whereby they are concealed from view by the locking member. It is to be understood, however, that at the expense of appearance, the ribs 270,271 may be disposed on the external surface of the locking member. Of course, if external and internal ribs are employed, the neutral axis would be shifted even further toward the line of loading and the ribs may be of sufficient mass whereby the neutral axis of the locking member will coincide with the line of loading of the latch.

The operation of the flexible over-center draw latch will now be described with reference to the sequential illustration thereof from a fully open, unlatched position (FIGS. 1 and 2) to a full closed, latched condition (FIGS. 5 and 6), it being understood that the embodiments illustrated in FIGS. 7–10 operates in a like manner.

Figure 3:
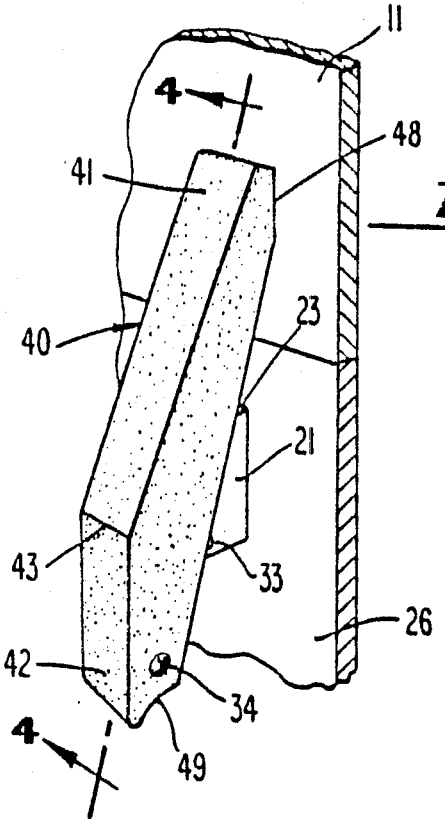
FIG. 3 is a perspective view of the invention illustrated in a partially latched condition.

From the fully open position of FIGS. 1 and 2, the locking member 40 is moved outwardly and upwardly and pivoted inwardly through lever 30 and pivot pins 33,34 to the position illustrated in FIGS. 3 and 4 whereby the keeper 10 is received in the channel 45 and notch 47. In the other embodiments of FIGS. 7-10, the transverse member 150,250 would be seated against curved leg 113,213 of keeper 110,210. From the position illustrated in FIGS. 3 and 4, the latch is closed by application of force to the locking member 40 in the direction of arrow 50 in FIG. 4. Upon movement of locking member 40 toward panel 26 to close the latch, lever 30 will pivot about pin 33 and locking member 40 will elongate as the on-center position is reached. Once the lever 30 crosses the on-center position lever 30 will pivot about pins 33 and 34, and locking member 40 will contract and "snap" to the closed position of FIGS. 5 and 6 to provide positive over-center latching. The resiliency of the locking member 40 retains the panels 11 and 25 securely together.

The on-center position of the latch in the preferred embodiment is illustrated in phantom in FIG. 9. It is at this point that the locking member is stretched to its maximum longitudinal dimension. The difference in the longitudinal dimension of the locking member from its unlatched position and the overcenter position expressed as a percent is at least substantially 1%, which is a visually perceptable elongation of the locking member. More preferably, the percent elongation of the locking member is substantially 4%.

For example, a latch according to the preferred embodiment of the present invention having a locking member 6 inches in length and made of SANTOPRENE® having a durometer hardness of 73 Shore A will elongate to approximately 6 5/16 inches at the oncenter position and its length when fully latched will be approximately 6¼ inches. Thus, in this example, the locking member undergoes 6% elongation as it reaches on-center from the unlatched position and contracts approximately 2% from the oncenter position to the fully latched position. Furthermore, in this example, a force of approximately 5 pounds is needed to move the locking member to a closed position and approximately 80 pounds of force is needed to lift the locking member to the unlatched position.

To open the latch, the forefinger is placed against concave surface 49 on tail section 42 and the thumb is placed on the face of locking member 40 near the crown 43 and the latch is snapped open by a simple lifting and squeezing movement of the thumb and forefinger. From the resulting position of the latch illustrated in FIGS. 3 and 4, the locking member 40 is lifted to disengage the keeper 10 and the panels 11,26 can be separated.

Figure 5:
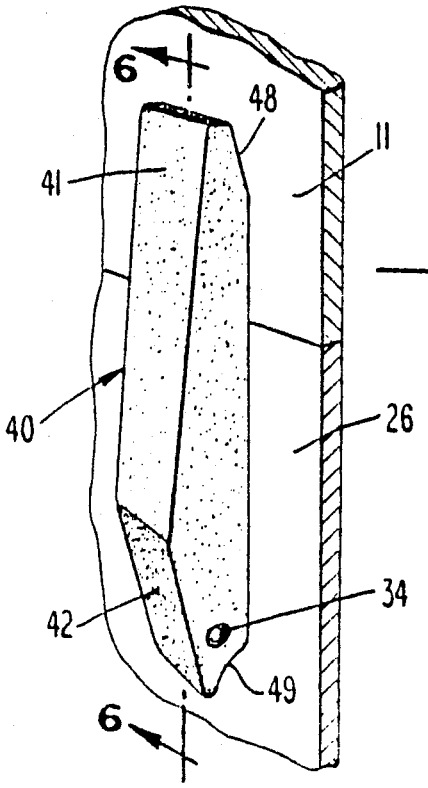
FIG. 5 is a perspective view of the invention illustrated in fully latched condition.

As seen in FIG. 5, the appearance of the latch when fully closed is a function of the shape and appearance of the locking member. Thus, locking member 40 can be made of any size or shape as may be considered desirable and furthermore may be of any color or colors, and the face thereof may be provided with a logo, trademark or other suitable indicia, as desired.

In can be seen from the above specification that the latch of the present invention, due to the presence of a flexible, elastic locking member, provides all of the advantages associated with flexible draw latches. For example, the flexibility of the locking member insures a positive latching action even if the mounting bracket and the keeper are not in precise alignment, and thus compensates for misalignment of the bracket and keeper due to improper installation or relative movement of the closure members. In addition, the load or tension generated by the locking member can be varied, within a particular range, by simply increasing or decreasing the distance between the mounting bracket and the keeper to provide a lesser or greater degree of stretch in the locking member when the latch is closed. Of course, if the distance is too short the locking member will not properly engage the keeper and the latch will be ineffective. Likewise, if the distance is too large, the latch will tend to release spontaneously because the stretch capabilities of the locking member have been exceeded. Moreover, because of the elasticity of the locking member, substantially all of the tensile forces in the latch will result in the elongation of the locking member and neither the dimensions of the lever and the mounting bracket nor their relative locations will be appreciably altered.

Preferred forms of the invention have been described and illustrated herein for purposes of illustration only and not for purposes of limitation, and various modifications or alternatives may suggest themselves to those skilled in the art, all of which are intended to be within the spirit and scope of the present invention as defined in the appended claims.

What is claimed is:

1. A draw latch for use in securing two closure members together, comprising:

(a) a keeper adapted to be affixed to a first closure member;

(b) a mounting bracket adapted to be affixed to a second closure member;

(c) a lever pivotally connected to said mounting bracket;

(d) an elastomeric locking member pivotally connected to said lever;

(e) a transverse member disposed through said locking member at a location remote from said connection with said lever, said transverse member being adapted to detachably engage said keeper;

(f) said pivot connection between said lever and said locking member being closer to said second closure member, when said mounting bracket is affixed to said second closure member, than said pivot connection between said lever and said mounting bracket when said latch is in a latched position, thereby comprising over-center means;

(g) said locking member comprising means increasing the mass of said locking member below the neutral axis thereof for increasing the resistance of said latch to opening;

(h) said locking member having sufficient flexibility to permit latching engagement when said keeper and said mounting bracket are misaligned.

2. The latch of claim 1, wherein said locking member elongates at least substantially 1% between the points of contact with said keeper and said lever when said latch passes over-center.

3. The latch of claim 1, wherein said locking member, when moved between latched and unlatched positions, undergoes visually perceptible elongation.

4. The latch of claim 1, wherein said locking member comprises a substantially flattened triangular-shaped member having peripheral side walls and ends, said locking member being of such size and dimension so as to substantially conceal said keeper, said bracket and said lever from view when said latch is in a latched position.

5. The latch of claim 1, wherein said elastomeric material has a durometer hardness measurable on the Shore A scale of hardness.

6. The latch of claim 5, wherein said elastomeric material is a natural rubber has a durometer hardness of from about 55 Shore A to about 87 Shore A.

7. The latch of claim 5, wherein said elastomeric material is a synthetic rubber having a durometer hardness of from about 55 Shore A to about 87 Shore A.

8. The latch of claim 1, wherein said locking member is provided with a first channel therein adapted to receive said lever when said latch is moved to a latched position; a second channel adjacent said first channel and longitudinally extending therefrom, said second channel being adapted to receive said mounting bracket therein when said latch is moved to said latched position; and a third channel adjacent said second channel and adapted to receive said keeper therein when said latch is in the latched position.

9. The latch of claim 8, wherein said second channel is of larger length and width than said first or third channels, and wherein the cross sectional area of said elastomeric material along said second channel i constant.

10. The latch of claim 9, wherein said first, second and third channels are defined by peripheral side and end walls of said locking member and a top portion of said locking member, wherein said keeper, said lever and said mounting bracket are substantially enveloped by said locking member when said latch is in the latched position so as to substantially conceal the keeper, lever and bracket from view.

11. The latch of claim 1, wherein said keeper comprises a mounting region adapted for mounting said keeper to said first closure member and a curved leg connected to said mounting region and extending therefrom, said curved leg being adapted for detachable engagement with said transverse member of said locking member.

12. The latch of claim 1, wherein said mounting bracket comprises a wedge-shaped member having a bottom wall adapted for mounting said mounting bracket to said second closure member and a pair of spaced-apart side walls connected to said bottom wall and disposed substantially perpendicular thereto.

13. The latch of claim 12, wherein one end of said lever is disposed between said spaced-apart side walls of said mounting bracket and connected thereto by a transverse member at a location spaced from said bottom wall.

14. The latch of claim 1, wherein said rib members are substantially triangular in cross-sectional shape.

15. A draw latch for use in securing two closure members together, comprising:

(a) a keeper adapted to be affixed to a first closure member;

(b) a mounting bracket adapted to be affixed to a second closure member;

(c) a lever pivotally connected to said mounting bracket;

(d) an elastomeric locking member pivotally connected to said lever;

(e) a transverse member disposed through said locking member at a location remote from said connection with said lever, said transverse member being adapted to detachably engage said keeper;

(f) said pivot connection between said lever and said locking member being closer to said second closure member, when said mounting bracket is affixed to said second closure member, than said pivot connection between said lever and said mounting bracket when said latch is in a latched position, thereby comprising over-center means;

(g) a pair of longitudinal rib members disposed on said locking member, said rib members comprising means for facilitating the over-center latching action of said over-center means; and (h) said locking member having sufficient elasticity to permit said locking member to elongate at least substantially 1% between the points of contact with said keeper and said lever when said locking member is moved between a latched and unlatched position.

16. The latch of claim-. 15, wherein said locking member has sufficient flexibility to permit latching engagement when said keeper and said mounting bracket are misaligned.

17. The latch of claim 15, wherein said elastomeric material is a natural rubber having a durometer hardness of from about 55 Shore A to about 87 Shore A.

18. The latch of claim 17, wherein said elastomeric material is a natural rubber having a durometer hardness of from about 55 Shore A to about 87 Shore A.

19. The latch of claim 17, wherein said elastomeric material is a synthetic rubber having a durometer hardness of from about 55 Shore A to about 87 Shore A.

20. The latch of claim 15, wherein said locking member is of a substantially flattened triangular shape having peripheral side walls, said locking member being of such size and shape so as to substantially conceal said keeper, said lever and said mounting bracket from view when said latch is in said latched position.

21. The latch of claim 15, wherein said mounting bracket comprises a wedge-shaped member having a bottom wall adapted for mounting said bracket to said second closure member and a pair of spaced-apart side walls connected to said bottom wall and disposed substantially perpendicular thereto.

22. The latch of claim 15, wherein the cross-sectional area of said elastomeric material along the portion of said locking member having said rib means disposed thereon is constant.

23. The latch of claim 15, wherein said rib members are substantially triangular in cross-sectional shape.

24. A draw latch for use in securing two closure members together, comprising:

(a) a keeper having (1) a mounting region adapted for mounting said keeper to a first closure member;

(2) a curved leg connected to said mounting region and extending therefrom;

(b) a mounting bracket having (1) a bottom wall adapted for mounting said bracket to a second closure member;

(2) a pair of spaced apart side walls connected to said bottom wall and disposed substantially perpendicular thereto;

(c) a lever, one end of which is disposed between said spaced-apart side walls of said mounting bracket and pivotally connected thereto;

(d) an elastomeric locking member pivotally connected to the other end of said lever;

(e) a transverse member disposed through said locking member at a location remote from said connection with said lever and positioned to detachably engage said curved leg of said keeper;

(f) said pivot connection between said lever and said locking member being closer to said second closure member, when said mounting bracket is affixed to said second closure member, than said pivot connection between said lever and said mounting bracket when said latch is in a latched position, thereby comprising over-center means;

(g) a pair of longitudinal rib members disposed on said locking member, said rib members being substantially triangular in cross-sectional shape, said rib members having sufficient mass to facilitate the over-center latching action of said over-center means;

(h) said locking member having a substantially flattened triangular shape with peripheral side walls and being of such size and dimension so as to substantially conceal said keeper, said lever and said mounting bracket when said latch is in a latched position;

(i) said locking member having (1) sufficient flexibility to permit latching engagement when said keeper and said mounting bracket are misaligned, (2) sufficient elasticity to permit visually perceptable elongation of said locking member by at least substantially 1% between the points of contact with said keeper and said lever when said locking member is moved between latched and unlatched positions; and (j) wherein said elastomeric material comprises a synthetic rubber having a durometer hardness of from about 55 Shore A to about 87 Shore A.

* * * * *

UNITED STATES PATENT AND TRADEMARK OFFICE

CERTIFICATE OF CORRECTION

PATENT NO. : 4,830,413

DATED : May 16, 1989

INVENTOR(S) : Robert H. Bisbing

It is certified that error appears in the above-identified patent and that said Letters Patent is hereby corrected as shown below:

Column 1, line 10, "186" should be --1986--.
Column 4, line 68, after "FIG." and before "is", insert --1--.

Column 6, line 28, "an" should be --and--.
Column 7, line 24, after "well" and before "a", delete "s" and insert --as--.
Column 11, line 33, after "channel" and before "constant" "i" should be --is--.

Signed and Sealed this

Fifth Day of December, 1989

*Attest:*

JEFFREY M. SAMUELS

*Attesting Officer* *Acting Commissioner of Patents and Trademarks*